US005755357A

United States Patent [19]

Orkin et al.

[11] Patent Number: 5,755,357

[45] Date of Patent: May 26, 1998

[54] COMPACT MEDICATION DELIVERY SYSTEMS

[75] Inventors: Fredric I. Orkin, Highland Park; John E. Prey, Jr., Tower Lakes; Theodore Liber, Highland Park, all of Ill.

[73] Assignee: HealthTech Services Corp., Northbrook, Ill.

[21] Appl. No.: 494,459

[22] Filed: Jun. 26, 1995

[51] Int. Cl.[6] ..... A61J 1/00

[52] U.S. Cl. ..... 221/82; 221/120; 221/121; 221/123; 221/197; 221/236; 221/258

[58] Field of Search ..... 221/82, 88, 89, 221/113, 120, 121, 119, 122, 196, 197, 236, 237, 258, 287, 69, 123

[56] References Cited

U.S. PATENT DOCUMENTS

| | | | |
|---|---|---|---|
| 3,329,080 | 7/1967 | Reach | 221/236 |
| 4,176,762 | 12/1979 | Scalera et al. | 221/121 |
| 4,572,403 | 2/1986 | Benaroya . | |
| 4,600,119 | 7/1986 | Olson . | |
| 4,695,954 | 9/1987 | Rose et al. . | |
| 4,725,997 | 2/1988 | Urquhart et al. . | |
| 4,748,600 | 5/1988 | Urquhart . | |
| 4,785,969 | 11/1988 | McLaughlin . | |
| 4,847,764 | 7/1989 | Halvorson . | |
| 4,872,591 | 10/1989 | Konopka . | |
| 4,953,745 | 9/1990 | Rowlett | 221/82 |
| 4,970,669 | 11/1990 | McIntosh et al. . | |
| 5,047,948 | 9/1991 | Turner . | |
| 5,084,828 | 1/1992 | Kaufman et al. . | |
| 5,148,944 | 9/1992 | Kaufman et al. . | |
| 5,176,285 | 1/1993 | Shaw . | |
| 5,230,441 | 7/1993 | Kaufman et al. . | |
| 5,335,816 | 8/1994 | Kaufman et al. . | |
| 5,442,728 | 8/1995 | Kaufman et al. . | |
| 5,472,113 | 12/1995 | Shaw | 221/82 |
| 5,609,268 | 3/1997 | Shaw | 221/82 |

FOREIGN PATENT DOCUMENTS

| | | |
|---|---|---|
| 523815 | 1/1939 | United Kingdom . |

*Primary Examiner*—H. Grant Skaggs
*Attorney, Agent, or Firm*—Ryan, Maki, Mann & Hohenfeldt

[57] ABSTRACT

A single, traveling actuator services multiple medication dispensing carousels to selectively dispense medication. The traveling actuator carries a tray that receives the dispensed medication. The tray flips to discharge the medication for patient use. The single actuator simplifies operation and reduces drop distance, thereby leading to a compact, low profile assembly.

17 Claims, 8 Drawing Sheets

COMPACT MEDICATION DELIVERY SYSTEMS

FIELD OF THE INVENTION

The invention generally relates to systems for dispensing medications. In a more particular sense, the invention concerns systems which oversee and coordinate the administration of complex medication regimens at home, outside the hospital or pharmacy, and without the day to day supervision of medical personnel. In this more particular sense, the invention also concerns automated home care patient health monitoring systems.

BACKGROUND OF THE INVENTION

Due to advances in medicine and medical treatments in general, people are living longer. As a result, the number and percentage of older people (referred to as "the elderly") are growing in the United States and elsewhere.

However, despite medical advances, many elderly still face chronic and debilitating health problems. Arthritis, hypertension, and heart conditions are but a few examples of the problems associated with longevity.

Treatment of these health problems often requires close compliance with relatively complex medication regimes. It is not unusual for a person having one of the above health problems to be taking four or more different prescription drugs at one time. These drugs often differ significantly in dosages, both as to time and amount, as well as in their intended physiological effects. These drugs also often differ in the severity of potentially adverse reactions due to mismedication.

Close and careful compliance with these complex medication regimes is a difficult task in itself. The difficulty is greatly enhanced, considering that the elderly must discipline themselves to follow these regimes at home, without the day-to-day support and supervision of trained hospital and pharmacy personnel, and often without the day-to-day support and supervision of their immediate families or other care givers. Furthermore, a loss in short term memory can be naturally attributed to the aging process and to the medication themselves, resulting in forgetfulness and further confusion in scheduling compliance with complicated medication regimes.

The invention is directed to improving the overall well-being and lifestyle of home care patients who are on complicated medication regimes. The invention addresses the problems of compliance with a complicated regime of differing medications and solves these problems by addressing the needs for self-sufficiency and personal control without sacrificing the overall therapeutic objectives of the prescribed medical treatment.

SUMMARY OF THE INVENTION

One aspect of the invention provides an apparatus for dispensing medication. The apparatus includes a housing carrying first and second carousels, each of which is adapted to hold medication. Each carousel includes a drive member to rotate the carousel to discharge medication.

According to this aspect of the invention, the apparatus includes a single actuator for dispensing medication from the carousels. A first driver moves the single actuator along a prescribed path in the housing between a first position and a second position. When in the first position, the actuator is in alignment with the drive member of only the first carousel. When in the second position, the actuator is in alignment with only the drive member of the second carousel. The actuator includes a second driver that engages only the drive member with which the single actuator is in alignment. The second driver imparts rotation only to the association carousel to dispense medication from it.

This aspect of the invention makes possible the use of a single, traveling actuator to operate multiple medication dispensing carousels.

According to another aspect of the invention, the apparatus includes first and second spaced apart panels each including a holder to releasably mount the first or second carousels for rotation relative to the panel. Each of the panels is independently supported by the housing for movement out of the housing and into the housing. When located outside the housing, the panel is accessible to mount or release the first or second carousel. When located inside the housing, the first or second carousel mounted on the panel is retained within the housing.

According to this aspect of the invention, when in the first position, the single actuator is aligned with the drive member of only the carousel the first panel retains within the housing. When in the second position, the single actuator is aligned with only the drive member of the carousel the second panel retains within the housing. The second driver engages the drive member with which the single actuator is in alignment to impart rotation to the association carousel to dispense medication from it.

This aspect of the invention couples the feature of a single, traveling actuator with movable support panels, which allow carousels to be changed and replaced. This aspect of the invention makes possible the use of disposable carousels.

Yet another aspect of the invention provides an apparatus for dispensing medication comprising a carousel adapted to hold medication. The carousel includes a drive member to rotate the carousel about a rotational axis to discharge medication. The apparatus includes a single actuator including first, second, and third drivers.

The first driver moves the single actuator in a first path generally parallel to the rotational axis of the carousel into and out of alignment with the drive member. The second driver engages the drive member the single actuator is in alignment with. The engagement imparts rotation to the carousel to dispense medication from the associated carousel.

According to this aspect of the invention, the single actuator includes a tray that moves with the single actuator along the first path to receive medication dispensed from the carousel rotated by the second driver. The third driver pivots the tray about an axis to discharge received medication. The pivot axis of the tray is generally parallel to the first path.

The provision of a tray, which travels to receive medication from a dispensing carousel along a first path, and which is also pivoted about an axis generally parallel to the first path to discharge the medication, eliminates the need for a stationary and often space-consuming collection trough beneath the carousel. The dual linear travel and pivot action of the tray also makes it possible to minimize the drop distance between the dispensing carousels and a remote patient pick-up site, particularly when the single actuator and tray service multiple carousels.

Another aspect of the invention provides a medication dispensing cassette comprising a wheel having circumferentially spaced apart walls defining compartments adapted to hold medication tablets. According to this aspect of the invention, the walls are formed of a flexible material that yields in response to external pressure to resist entrapment of medication tablets in the compartments.

Other features and advantages of the invention will become apparent upon reviewing the following detailed description, drawings, and appended claims.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF THE PREFERRED EMBODIMENTS

Figure 1:
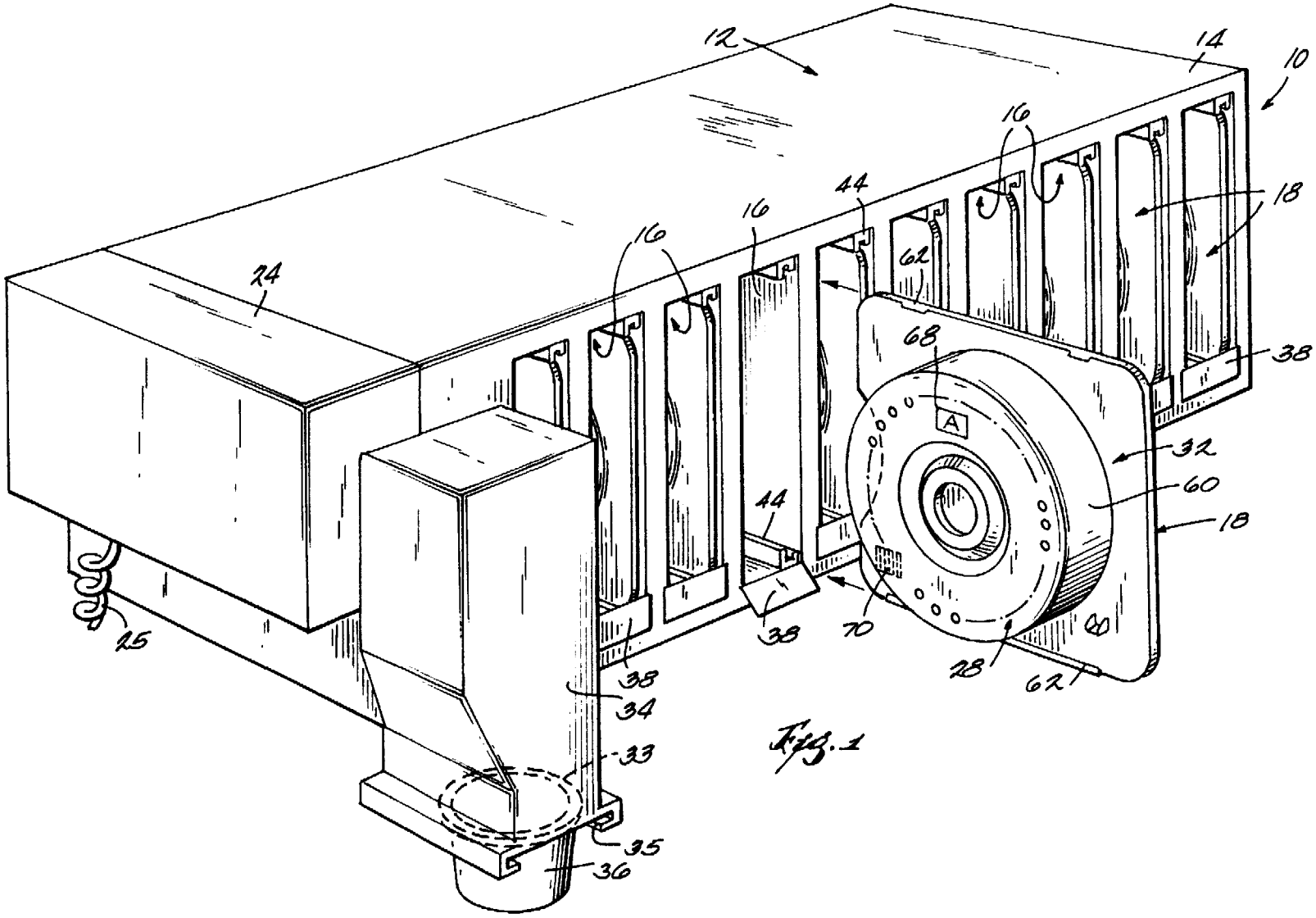
FIG. 1 is a perspective view of a medication dispensing module that embodies the feature of the invention, with one of the associated medication dispensing carousels pulled out of its bay.
Figure 2:
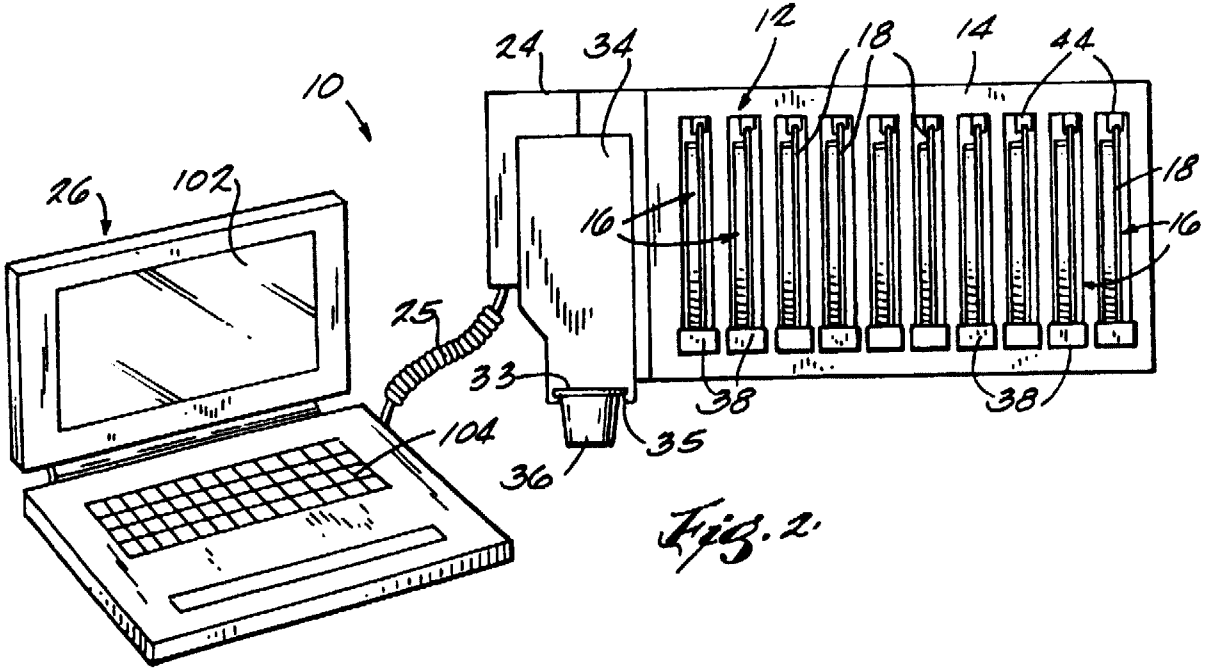
FIG. 2 is a perspective view showing the medication dispensing module shown in FIG. 1 in association with a user interface.

FIGS. 1 and 2 show a medication dispensing system 10 that embodies the features of the invention. The system 10 includes a dispensing module 12 housed within a low profile cabinet 14, which, in size, could easily fit on a table top for chair-side access. In a representative implementation, the cabinet 14 measures about 14 inches wide by 10 inches high by 15 inches deep.

It should also be appreciated that, due to its low profile design, the medication dispensing module 12 could be incorporated as part of an interactive patient monitoring system, such as disclosed in Kaufman et al U.S. Pat. No. 5,084,828 or Kaufman et al U.S. Pat. No. 5,142,484, which are incorporated herein by reference.

The dispensing module 12 has a number of side-by-side bays 16. Each bay 16 is adapted to hold a medication storage carousel 18. The bays 16 hold the carousels 18 in a generally vertical orientation. The close, side-by-side, vertical orientation of the carousels 18 contributes to the low profile and a small footprint design of the module 12.

Each carousel 18 holds medication in single dosage form. In the illustrated embodiment, the medication is in the form of a tablet 20 (see FIG. 9, for example), like conventional pills or caplets. Still, other unit or multiple dosage packets can be used.

The module 12 is able to store several, different medication types, segregated in individual carousels 18 in different bays 16, kept safely away from immediate access by the patient. As will be described in greater detail later, a single actuator mechanism 22 in the module 12 selectively accesses and dispenses medication from the individual carousels 18.

The system 10 also includes a controller 24 that issues prescribed control commands to the actuator mechanism 22. The controller 24 can command the actuator mechanism 22 to administer a single medication dose or a regime of several, different medications from the carousels 18, either upon the command of the patient or, if desired, according to a schedule prescribed by a heath care professional.

In the illustrated embodiment, the controller 24 is carried on board the module 12. It consists of a conventional programmable host microprocessor with associated RAM and hard drive data storage carried in the module 12.

In this implementation, the controller 24 is coupled by a cable 25 to a remote interface 26 (see FIG. 2). The interface 26 receives input commands from the user or medical attendant and conveys them to the controller 24. The interface 26 also outputs information and prompts for the user or medical attendant under the command of the controller 24.

The interface 26 preferably includes a CRT or LED display 102 for information output. The interface 26 also includes an input device 104, which can take the form of a conventional keyboard, and/or point-and-click mouse, and/or a touch screen input. The interface 26 can also incorporate voice input recognition and digitalized voice generation output.

It should be appreciated that, should the module 12 be incorporated into an overall patient monitoring system, such as disclosed in the above cited Kaufman et al patents, the controller 24 for the module 12 could share the interface and communicate with the host processor of the overall system in performing its specialized medication dispensing functions.

In the illustrated and preferred embodiment, the controller 24 is also linked by modem to a central station staffed by medical personnel. The controller 24 also preferably includes watch-dog monitoring of system operation with appropriate alarms should prescribed, undesirable system operating modes be detected.

In the illustrated and preferred embodiment (see FIGS. 5 to 8), each carousel 18 comprises a cassette 28 having circumferentially spaced compartments 30 for carrying unit dosage medication 20. Each cassette 28 is releasably carried for rotation on a sliding panel 32 (see FIG. 1 also). As FIG. 1 shows, each panel 32 individually slides into and out of an associated bay 16.

As FIG. 1 demonstrates, pulling the panel 32 out from the bay 16 provides easy, direct access to the cassette 28. With the panel 32 pulled out, a single cassette 28, containing prescribed medication 20 preferably preloaded by a professional medical attendant, can be easily mounted on or removed on the panel 32 (see FIGS. 6 and 7).

Figure 3:
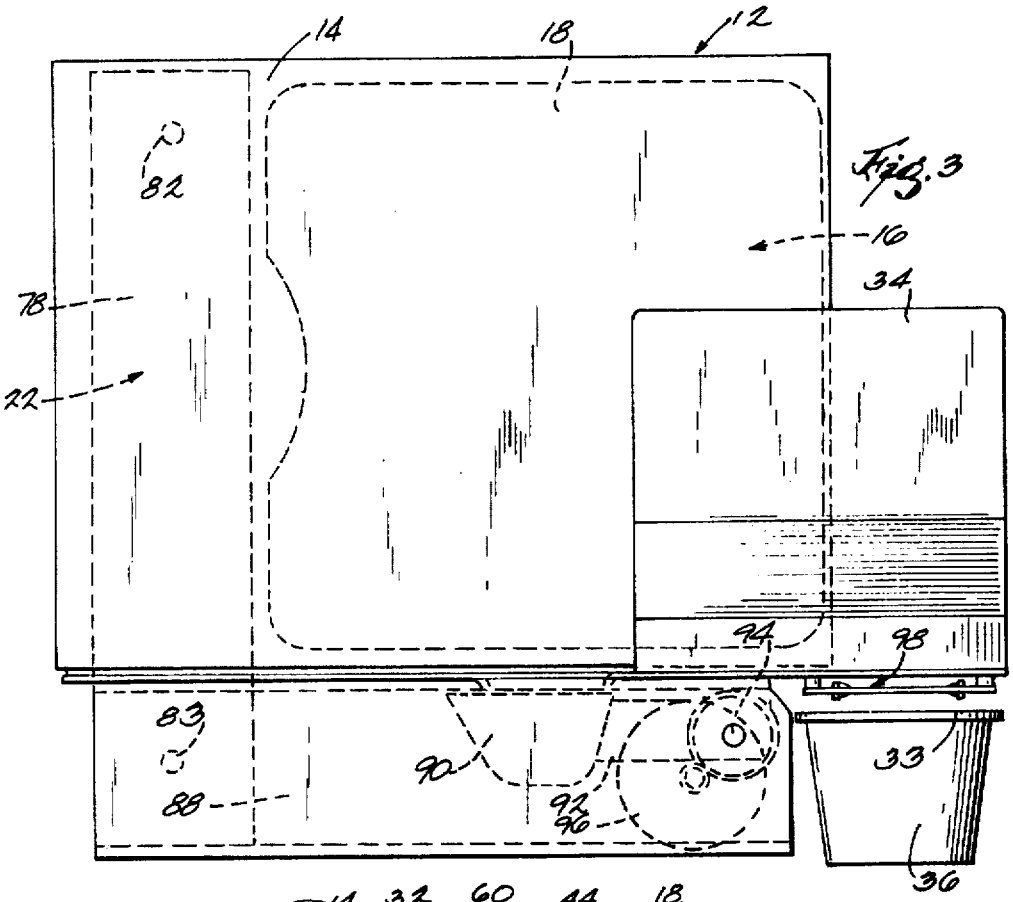
FIG. 3 is a side elevation view of the medication dispensing module shown in FIG. 1.
Figure 4:
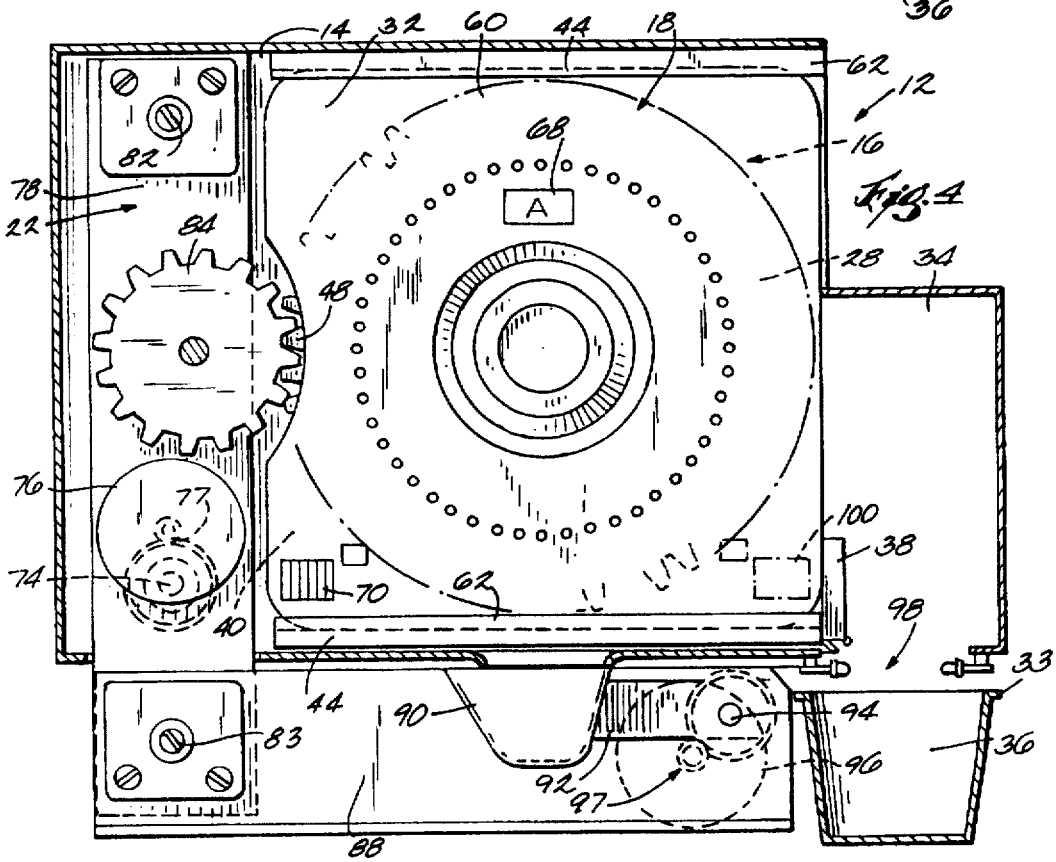
FIG. 4 is a side elevation view of the interior of the medication dispensing module shown in FIG. 1, showing the single actuator that selectively engages multiple medication dispensing carousels within the module.

As FIGS. 3 and 4 best show, with the panels 32 and attached cassettes 28 moved into the bay 16, the single actuator mechanism 22 is moved into selective engagement with selected cassettes 28 in the module 12, one cassette 28 at a time. The actuator mechanism 22 dispenses medication 20 from the engaged cassette 28.

As will be described in greater detail later, the actuator mechanism 22 also delivers the dispensed medication through an outlet 34 to a cup 36 for taking by the patient (see FIGS. 1 to 4). The same actuator mechanism 22 selectively dispenses medication from all cassettes 28 for delivery to the patient via the single outlet 34. As FIG. 1 best shows, the cup 36 includes ears 33 which engage brackets 35 on the outlet 34, to slidably mount the cup 36 in alignment with the outlet 34.

If desired, a suitable electrically actuated latching mechanism 38 (see FIGS. 1 and 2) is preferably provided to releasably lock each panel 32 in its fully inserted position within the bay 16. The latching mechanism 38 (which can be solenoid activated, for example) is preferably released to gain access to each cassette 28 only by established pass word or comparable security measures under the control of trained medical personnel. The patient is thus required to obtain medication 20 under the control of the controller 24.

In the illustrated and preferred embodiment, the cassettes 28 are intended to be single use, disposable items. When a given cassette 28 empties, the medical attendant opens the associated slide panel 32, removes the used cassette 28 from the panel 32, and discards the used cassette 28. The medical attendant mounts a new cassette 28 on the panel 32, and slides the panel 32 back into position within the module 12.

Figure 5:
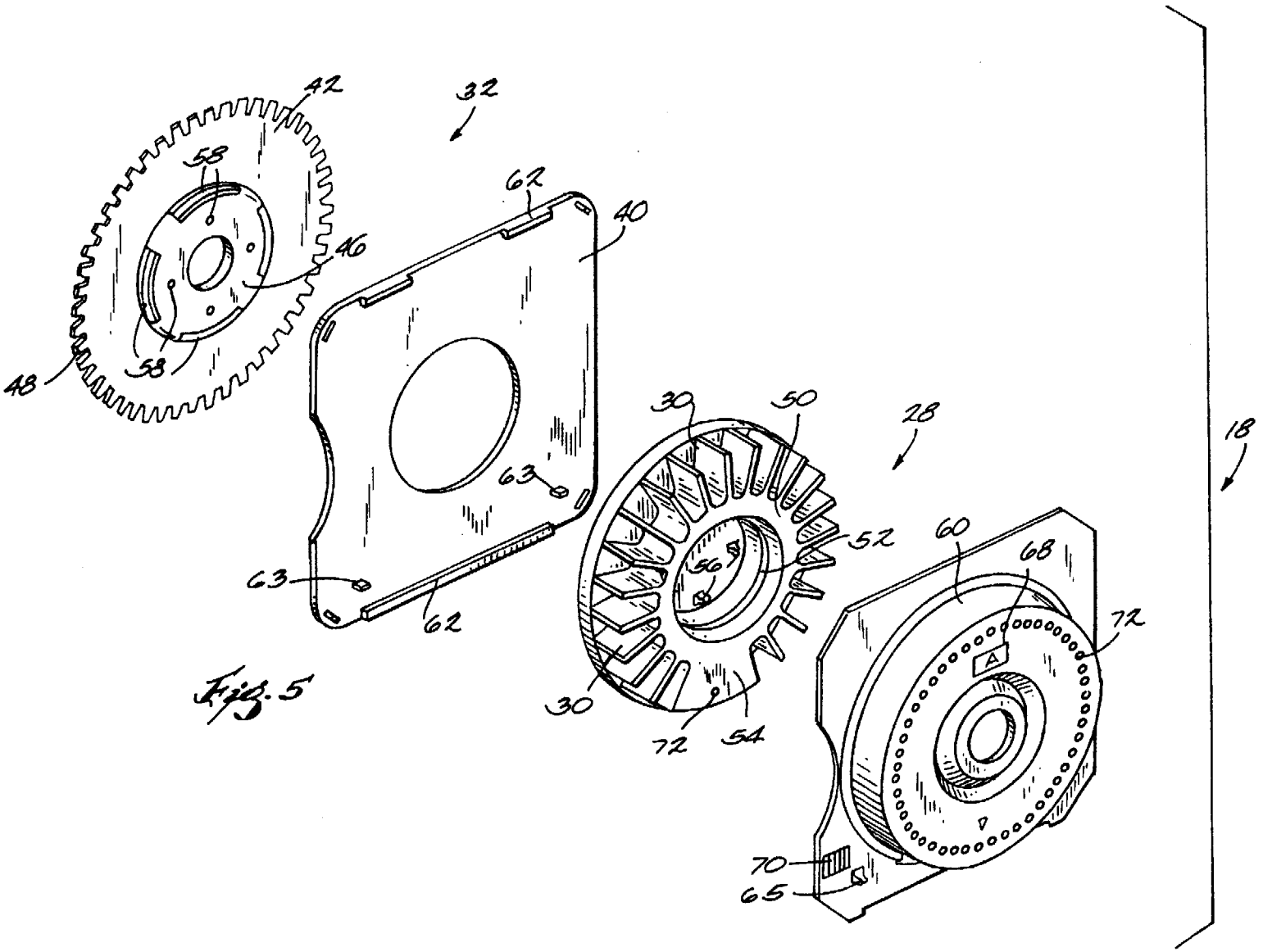
FIG. 5 is an exploded perspective view of the panel and cassette components of the medication dispensing carousel that is used in association with the module shown in FIG. 1.
Figure 6:
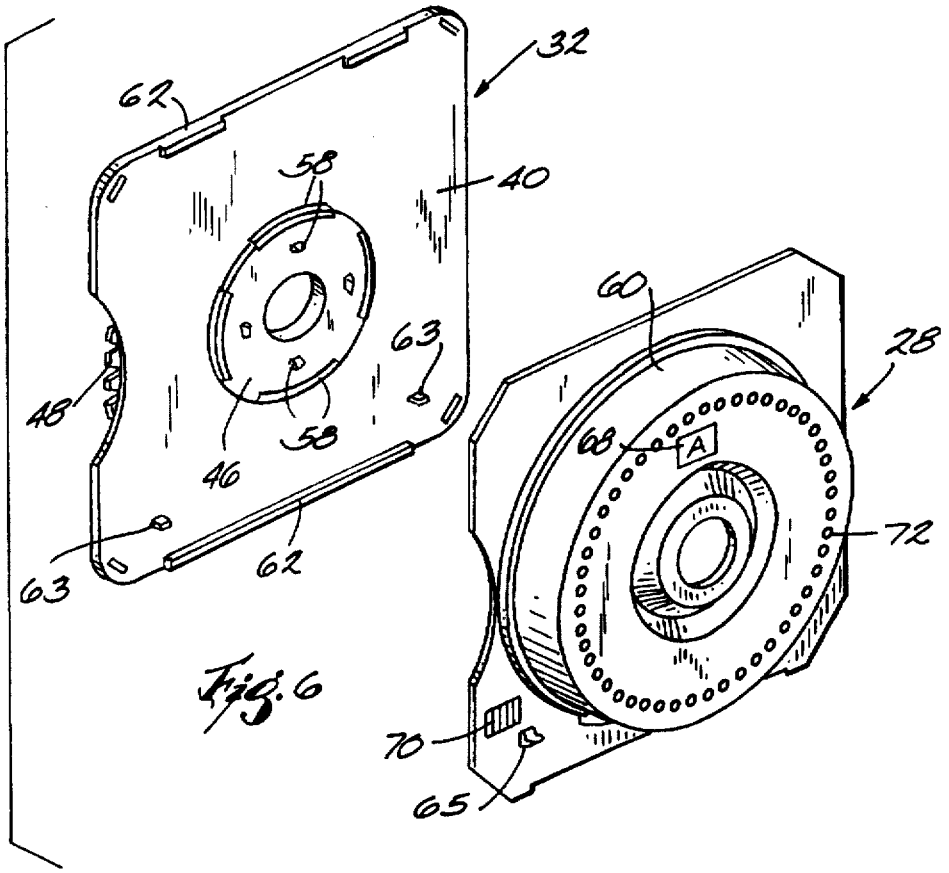
FIG. 6 is a perspective view of the assembled panel and assembled cassette components shown in FIG. 5, with the panel and cassette in a separated condition prior to use.
Figure 7:
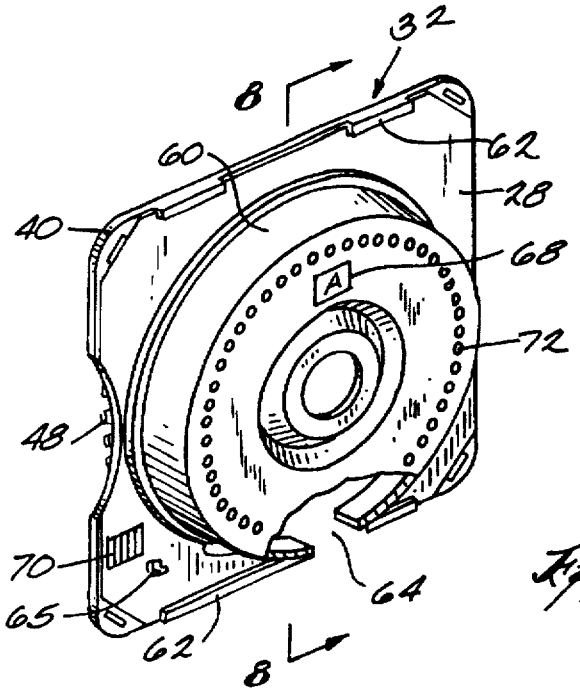
FIG. 7 is a perspective view of the panel and cassette shown in FIG. 6, with the cassette mounted on the panel, ready for use.

FIGS. 5 to 7 show further details of the medication storage carousel 18 that embodies the features of the invention. Each panel 32 comprises a stationary plate 40 carrying a cassette wheel 42. The upper and lower edges of each plate 40 ride in track brackets 44 (see FIGS. 1, 2, and 4) in the associated bay 16. This provides the in-and-out sliding movement of the panel 32.

In the illustrated embodiment, the plates 42 move independently along the track brackets 44 by push-pull force manually applied. In an alternative embodiment, the push-pull force can be applied by an electrical drive assembly (not shown), such as found in a conventional compact disk player.

The cassette wheel 42 includes a hub 46 (see FIG. 5) which, when assembled (see FIG. 6), projects through the center of the plate 42. The cassette wheel 42 also includes a peripheral gear 48. The cassette wheel gear 48 is exposed along the edge of the plate 40 that, in use, faces into the bay 16 (see FIGS. 4 and 7). As FIG. 4 shows, and as will be described in greater detail later, when the plate 40 is positioned within the module 12, the actuator mechanism 22 engages the cassette wheel gear 48 to rotate the cassette wheel 42 on the plate 40.

In the illustrated and preferred embodiment (as best shown in FIG. 5), the cassette 28 includes a medication carrier 50. The medication carrier 50 is preferably formed into a carousel shape, which has the circumferentially spaced, generally V-shaped compartments 30 extending radially from a center hub 52. The compartments 30 are open at their outer peripheral region (see FIG. 9 as well), except for one closed segment 54.

Figure 8:
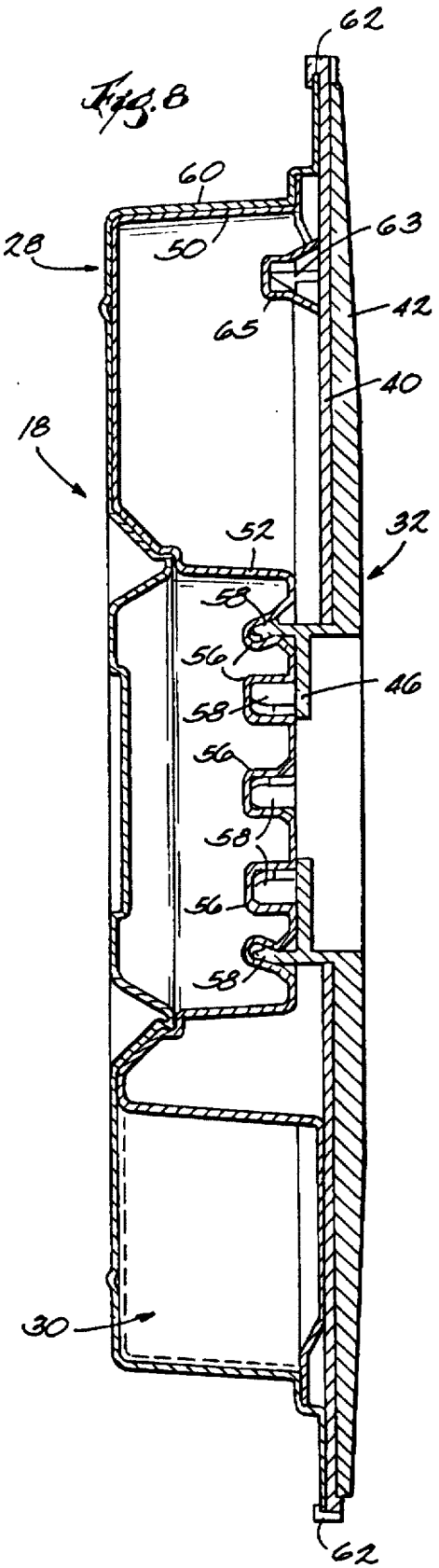
FIG. 8 is a side section view of the cassette mounted on the panel taken generally along line 8—8 in FIG. 7.

The center hub 52 of the medication carrier 50 nests in a secure friction fit about the hub 46 of the cassette wheel 42 (as FIG. 8 best shows). The carrier hub 52 also preferably includes interior slots 56 that engage exterior tabs 58 on the wheel hub 46. Rotation of the cassette wheel 42 is thereby translated into rotation of the medication carrier 50.

The cassette 28 further includes a cover 60, which is dome-shaped to fit over and enclose the medication carrier 50. Brackets 62 on the plate 40 (see FIG. to 7) grip the side edges of the cover 60 to hold it stationary on the plate 40 while the medication carrier 50 rotates within it. Tabs 63 on the plate 40 also mate with slots 65 on the cover 60 to assure that the cover 60 is attached in the proper orientation on the plate 40.

Figure 11:
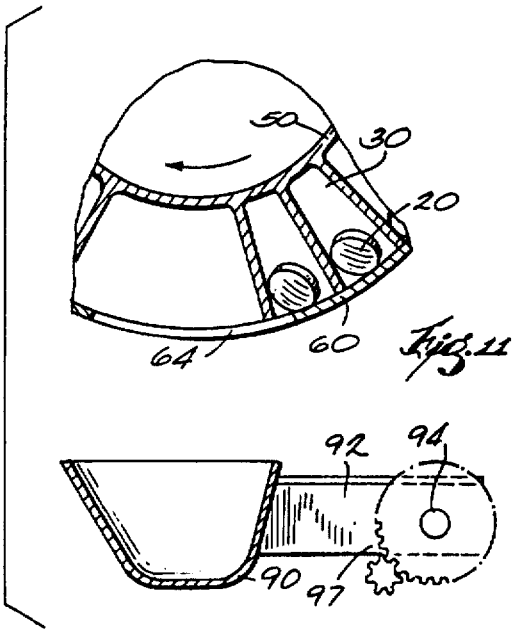
FIGS. 11 and 12 are enlarged side section views showing the rotation of the cassette by the actuator to dispense medication into the tray that the actuator carries.
Figure 12:
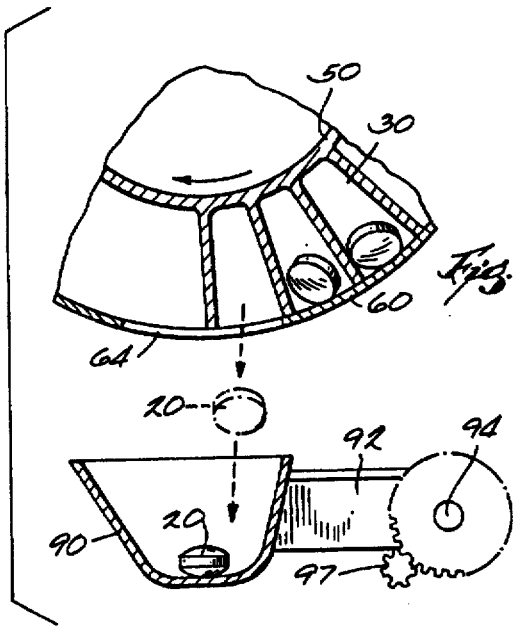

The cover 60 includes a bottom opening 64 (see FIG. 7) that, when the cover 60 is properly oriented on the plate 40, faces downward. As a compartment 30 rotates into alignment with the cover opening 64 (as FIGS. 11 and 12 show), medication 20 in the compartment 30 falls by gravity through the opening 64.

Figure 9:
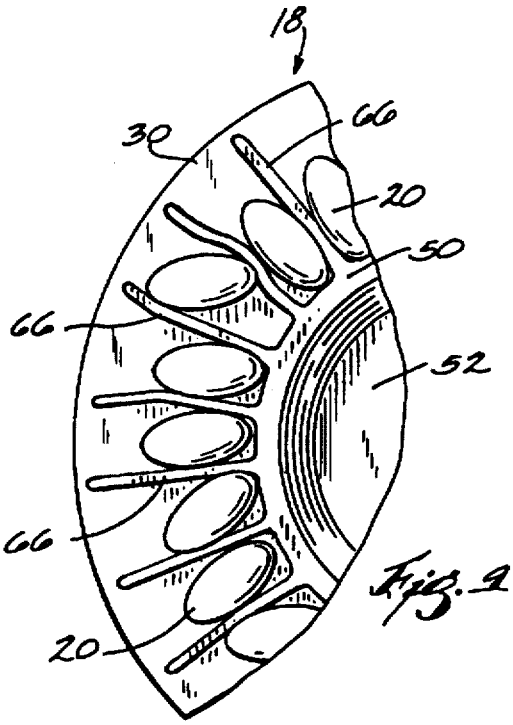
FIG. 9 is an enlarged interior view of the medication containing compartments within a cassette, showing the yieldable nature of the interior compartment walls.

Preferably, the medication carrier 50 is formed by vacuum molding or like process from a relatively flexible, "soft" plastic material. As FIG. 9 shows, due to the use of soft plastic materials, the compartment walls 66 readily yield to pressure or contact. As FIG. 9 also shows, the compliant walls 66 resist the entrapment of medication 20 in the compartment 30, particularly when medication 20 moves crosswise, especially in the more narrow region of the compartment 30 next to the hub 52. A given compartment 30 is therefore more certain to release its contents by gravity fall through the cover opening 64, when rotation of the medication carrier 50 orients the compartment 30 in alignment with the opening 64. As will be described in greater detail later, the actuator mechanism 22 can also gently oscillate the medication carrier 50 to shake loose any entrapped medication 20.

The cover 60 is preferably molded from a more rigid, yet still somewhat flexible, plastic material.

In a preferred manner of use, a medical attendant loads single dose unit medication 20 into each compartment 30, while the medication carrier 50 is off the plate 40 and out of association with the cover 60. Upon loading the compartments 30, the medical attendant fits the cover 60 over the medication carrier 50 and initially aligns the closed segment 64 with the cover opening 64. The medication is therefore kept secure within the assembled cassette 28 until use.

The medical attendant also preferably applies a label 68 to the front of the cover 60, identifying the contents of the assembled cassette 28. The medical attendant may also apply a peel-away film (not shown) to the back of the cover 28 to seal the cassette 28 until use.

As will be described in greater detail later, the medical attendant also preferable attaches a bar code or other machine readable indicia 70 to the cassette cover 60 that uniquely identifies the contents of the cassette 28.

Preferably, the dimensional tolerances of the medication carrier 50 and cover 60 provide a snug, yet yielding, friction fit. This mechanical fit resists separation and relative rotation of the carrier 50 and cover 60 during normal handling. In the illustrated and preferred embodiment, mating, circumferentially spaced detents 72 in the carrier 50 and cover 60 provide additional resistance to relative rotation. Once the assembled cassette 28 is mounted on the plate 40 and located within the module 12, the mechanical resistances yield to the increased, focused force applied by the actuator mechanism 22.

To load an assembled cassette 28, the medical attendant slides the desired panel 32 out from its bay 16 and removes the existing cassette 28. The medical attendant fits the carrier hub 50 onto the new cassette wheel hub 46, assuring that the cover opening 64 faces in the downward gravity position. The medical attendant flexes the peripheral edges of the cover 60 as necessary to capture them within the panel brackets 62. The orientation tabs 63 and slots 65 will mate, confirming the correct orientation. The medical attendant then slides the panel 32 back into its bay 16. To remove the assembled cassette 28 from the panel 32, the medical attendant essentially follows these steps in reverse.

FIGS. 4 and 10 to 15 show the details of the actuator mechanism 22 and its interaction with the individual carousels 18 within the module 12. The actuator mechanism 22 includes a linear screw gear 74 that extends across the rear interior of the module 12 (see FIG. 4). A motor 76 coupled by gears 77 to one end of the screw gear 74 (see FIG. 10) rotates the screw gear 74 in either clockwise or counterclockwise directions.

Figure 10:
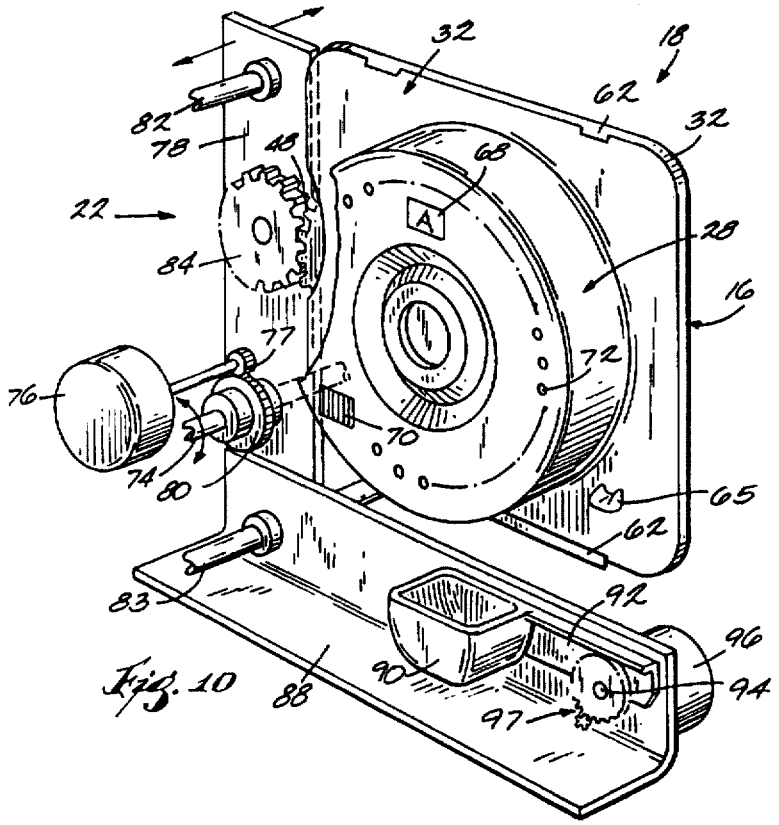
FIG. 10 is a perspective view of the single actuator shown in FIG. 4, with the actuator engaged with a selected cassette for dispensing medication.

The actuator mechanism 22 also includes an actuator carrier 78 that travels upon the screw gear 74 behind the panels 32. A fixed nut 80 carried by the lower region of the carrier 78 engages the threads of the screw gear 74. Rotation of the screw gear 74 advances the nut 80 along the gear 74, causing linear movement of the carrier 78 (as the arrows in FIG. 10 show). The upper and lower regions of the carrier 78 slide along guide tubes 82 and 83, which extend above and below and parallel to the screw gear 74. The carrier 78 travels either left or right along the screw gear 74, depending upon the direction the screw gear 74 rotates.

Figure 13:
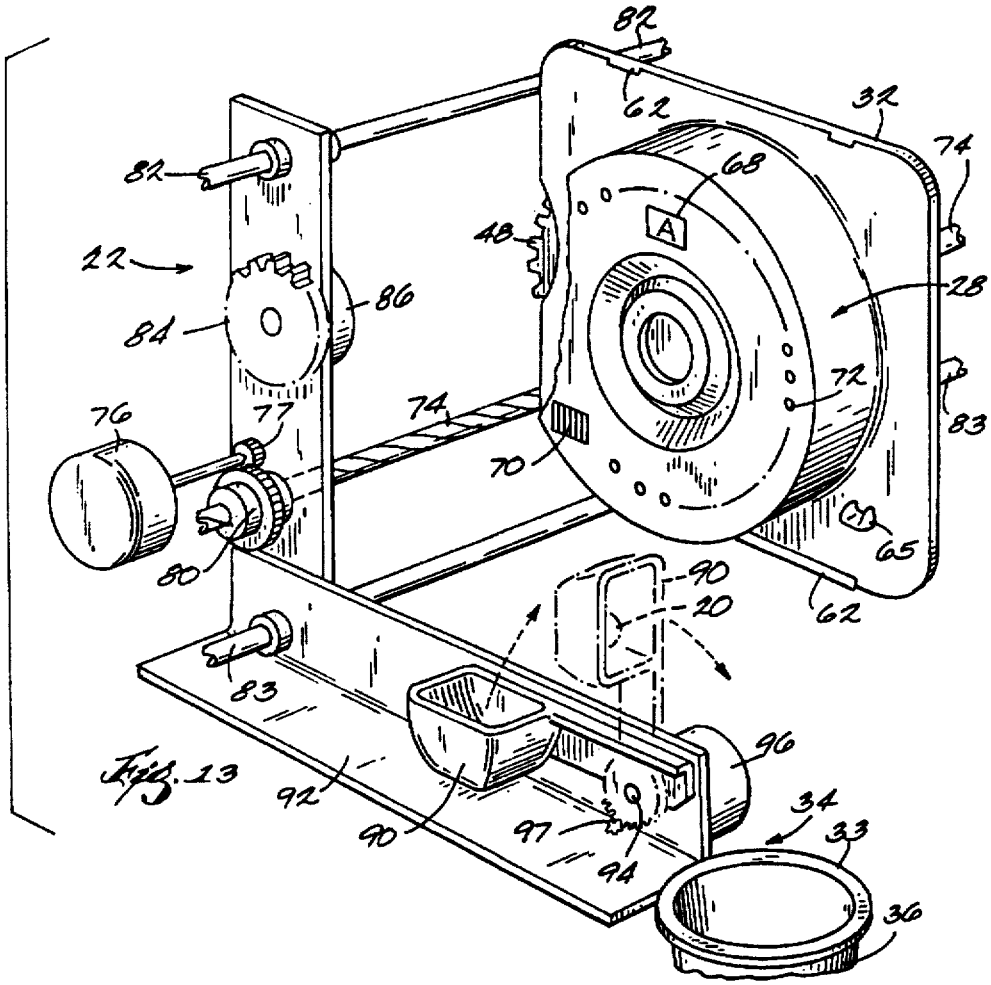
FIG. 13 is a perspective view of the single actuator shown in FIG. 10, with the actuator moved from the selected cassette and into alignment with the outlet for discharging medication dispensed from the cassette.

The actuator carrier 78 supports a cassette drive gear 84 and associated drive motor 86 (shown in FIG. 13). As the carrier 78 travels along the screw gear 74, the cassette drive gear 84 moves in succession into and out of engagement with individual cassette wheel gears 48. The cassette drive gear 84 can engage only one cassette wheel gear 48 at a time.

When the cassette drive wheel 84 engages a cassette wheel gear 48 (as FIGS. 4 and 10 show), actuation of the drive motor 86 imparts rotation to the medication carrier 50 within the cover 60 (see FIG. 11). This, in turn, dispenses medication through the cover opening 64 (see FIG. 12), as before described.

In the illustrated and preferred embodiment, the drive motor 76 for the screw gear is a stepper motor. By correlating motor steps to position of the actuator carrier 78, the drive motor 76 can be commanded to selectively position the actuator carrier 78 to bring the cassette drive gear 84 into engagement with only a selected one of the cassette wheel gears 48.

The controller 24 includes a look up table, or its equivalent, which correlates the number of steps of the motor 76 to the position along the screw gear 74 of each cassette wheel gear 48. Using this information, the controller 24 generates commands to the screw gear drive motor 76 to step the carrier 78 along the screw gear 74 to bring the cassette drive gear 84 into engagement with a selected one of the cassette wheel gears 48.

In the illustrated and preferred embodiment, the motor 86 for the cassette drive gear 84 is also a stepper motor. The steps of this motor 84 can be correlated to rotational advancement of the cassette wheel 42 sufficient to incrementally move a compartment 30 into alignment with the cover opening 64.

Once the controller 24 issues commands to achieve engagement between the cassette drive gear 84 and the desired cassette wheel gear 48, the controller 24 can generate additional commands to the motor 86 to incrementally advance the cassette wheel 42 to dispense the contents of one cassette compartment 30.

Figure 14:
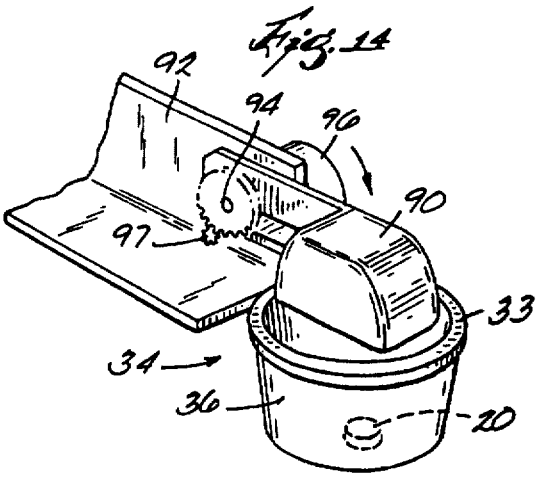
FIGS. 14 and 15 are enlarged side views, with FIG. 15 partially in section, showing the discharge of medication from the tray into a waiting cup by pivoting the tray.
Figure 15:
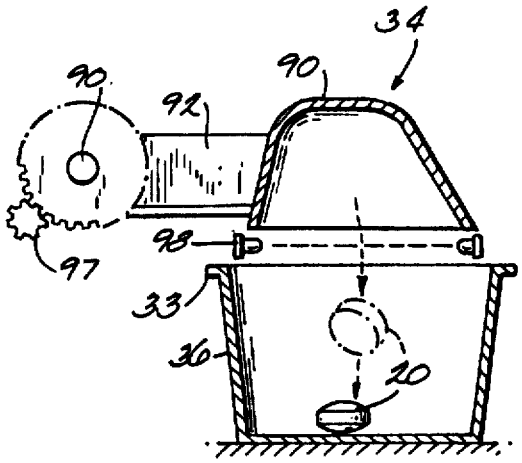

The lower region of the carrier includes a bracket 88 (see FIG. 10) that extends beneath the panels 32. The bracket 88 carries a tray 90. An arm 92 couples the tray 90 to an axle 94, about which the arm 92 pivots to flip the tray 90 between a first, upturned position (as FIGS. 10 to 12 show) and a second, overturned position (as FIGS. 14 and 15 show). Phantom lines in FIG. 13 show the tray 90 in an intermediate position between the upturned and overturned positions. A motor 96 is coupled by gears 97 (see FIG. 10) to the axle 94 to flip the tray 90 between its upturned and overturned position.

When in the upturned position (see FIG. 10), the tray 90 is located directly beneath the cover opening 64 of the cassette 28 for which the cassette drive gear 84 drive and the cassette wheel gear 48 are engaged (see FIGS. 11 and 12). Medication 20 that drops from the cassette compartment 30 through the opening 64 upon rotation of the medication carrier 50 by the drive motor 86 lands in the upturned tray 90.

In the illustrated and preferred embodiment, the outlet 34 is located at one end of the module 12 (see FIG. 1). The look up table of the controller 24 includes the steps required to move the actuator carrier 78 into alignment with the outlet 34 (as FIG. 13 shows). Subsequent activation of the motor 96 by the controller 24 flips the tray 90 from its upturned position (as FIG. 13 shows) to its overturned position (as FIGS. 14 and 15 show). The tray 90 drops medication 20 through the outlet 34 into the cup 36.

The provision of an upturned medication receiving tray 90, which travels to service multiple medication dispensing carousels 18 along an elongated linear axis (i.e., the axis of linear screw gear 74), and which can also be flipped about an axis (i.e., axle 94) generally parallel to this axis into a down turned position to dump its contents, eliminates the need for a stationary, space-consuming collection trough beneath all carousels 18. The dual linear motion and flip-flop action of the tray 90 makes it possible to minimize the drop distance between multiple medication dispensing carousels and a single pick-up site (i.e., funnel 34).

In summary, the controller 24 executes a delivery cycle by first commanding the motor 96 to flip the tray 90 into its upturned position. The controller 24 commands the motor 76 to step-move the actuator carrier 78 so engage the cassette drive gear 84 with a selected one of the cassette wheel gears 48 (as FIG. 10 shows). The controller 24 then commands the motor 86 to step-rotationally advance the associated medication carrier 50 of the carousel 18 to drop medication 20 from one compartment 30 into the tray 90 (as FIGS. 11 and 12 show).

In the preferred embodiment, the controller 24 commands the motor 86 to step back and step forward of the preestablished "drop" step position, to oscillate the medication carrier 50. The oscillation serves to shake loose medication that, for whatever reason, becomes lodged in the compartment 30.

The controller 24 then commands the motor 76 to step-move the actuator carrier 76 into alignment with the outlet 34 (as FIG. 13 shows). The controller 24 commands the motor 96 to flip the tray 90 into its overturned position (as FIG. 14 shows). The medication 20 falls in the tray 90 falls into the waiting cup 36 for use by the patient (as FIG. 15 shows).

In the illustrated and preferred embodiment, an optical or magnetic motion detector 98 (see FIGS. 4 and 15) senses passage of the medication 20 from the tray 90 into the cup 36. In this way the controller 24 confirms the delivery of medication 20 to cup 36, ending one delivery cycle.

The controller 24 repeats the above cycle to individually dispense additional medication from other carousels 18 into the cup 36, as required.

In the illustrated and preferred embodiment, the indicia 70 on the cover 60 of each cassette 28 identifies the medication that the cassette 28 contains, for example, by generic name, unit dosage amount, and the number of dosage units in the cassette. A reader 100 for the indicia 70 (see FIG. 4) is located in each bay 16. The readers 100 are coupled to the controller 24. Upon movement of the panel 32 into the bay 16, the reader 100 scans the indicia. The reader 100 outputs to the controller 24 the coded information. Alternatively, this information can be manually entered using the interface 26.

In this way, the controller 24 correlates panel location to medication type. The controller 24 can therefore locate the desired cassette 28. The controller 24 can also keep a record reflecting a rolling inventory of medication in the module 12, the dispensing of medication from carousels 18, and other information of interest to the medical attendant. The controller 24 can also issue refill alarms when the inventory of medication in a given carousel 18 falls below a prescribed level.

Medication carriers 50 having different size compartments 30 can be fabricated to accommodate different size medications. In this arrangement, the coded indicia 70 can also identify the number of steps required for the motor 86 to rotational advance the particular carrier 50 to dispense medication from one compartment. In this way, the controller 24 is able to adjusts its commands to the motor for different cassette sizes. Alternatively, this information can be manually entered using the interface 26.

The controller 24 can dispense medication from one or more carousels 18 in the above manner upon request from the patient or a medical attendant through the system interface 26. Alternatively or in combination, the controller 24 can retain a prescribed medication regime in its memory, including the types of medication to be dispensed and the schedule of dispensing. In this arrangement, the controller 24 commands automated medication dispensing according to the prescribed regime retained in memory.

The details of various medication dispensing regimes that the controller 24 can follow are set forth in Kaufman et al. U.S. Pat. No. 5,084,828, which are incorporated herein by reference.

The module 12 as above described can be powered by AC line current, batteries, or, preferably, both. In this latter arrangement, the controller 24 senses line power loss and automatically switches to backup battery power.

The features of the invention are set forth in the following claims.

We claim:

1. An apparatus for dispensing medication comprising a housing, first and second carousels in the housing each adapted to hold medication, each carousel including a drive member to rotate the carousel, each carousel including an outlet through which medication is discharged during rotation, and a single actuator in the housing including a first driver to move the single actuator along a prescribed path between a first position in alignment with the drive member of only the first carousel and a second position in alignment with only the drive member of the second carousel, the actuator including a second driver that engages only the drive member with which the single actuator is in alignment to impart rotation only to the association carousel to dispense medication.

2. An apparatus according to claim 1 wherein the single actuator includes a tray that moves with the single actuator to receive medication dispensed from the carousel rotated by the second driver.

3. An apparatus according to claim 2 wherein the single actuator includes a third driver that overturns the tray to discharge received medication.

4. An apparatus according to claim 2 and further including a single medication discharge outlet in the housing, and wherein the first driver moves the single actuator to a third position in alignment with the medication discharge outlet, and wherein the third driver overturns the tray to discharge received medication through the discharge outlet.

5. An apparatus according to claim 1 wherein at least one of the carousels includes circumferentially spaced apart walls defining compartments adapted to hold medication tablets, the walls being formed of a flexible material that yields in response to external pressure to resist entrapment of medication tablets in the compartments.

6. An apparatus for dispensing medication comprising a housing, first and second cassettes each adapted to hold medication, each cassette including an outlet through which medication is discharged during rotation of the cassette, first and second spaced apart panels each including a drive member to releasably engage the first or second cassette for rotation on the panel, each of the panels being independently supported by the housing for movement out of the housing, thereby providing access to the panel to engage the drive member to or release the drive member from the first or second cassette, and for movement into the housing, thereby retaining the first or second cassette engaged to the drive member within the housing, and a single actuator supported by the housing including a first driver to move the single actuator between a first position in alignment only with the drive member engaging the cassette that the first panel retains within the housing, and a second position in alignment only with the drive member engaging the cassette that the second panel retains within the housing, the actuator including a second driver that engages the drive member with which the single actuator is in alignment to impart rotation to the association cassette to dispense medication.

7. An apparatus according to claim 6 wherein the first and second panels move in a first path, and wherein the single actuator moves in a second path generally transverse of the first path.

8. An apparatus according to claim 7 wherein the single actuator includes a tray that moves with the single actuator to receive medication dispensed from the cassette rotated by the second driver, and wherein the single actuator includes a third driver that pivots the tray about an axis to discharge received medication, the axis lying generally parallel to the second path.

9. An apparatus according to claim 6 wherein the single actuator includes a tray that moves with the single actuator to receive medication dispensed from the cassette rotated by the second driver.

10. An apparatus according to claim 9 wherein the single actuator includes a third driver that overturns the tray to discharge received medication.

11. An apparatus according to claim 9 and further including a single medication discharge outlet in the housing, and wherein the first driver moves the single actuator to a third position in alignment with the medication discharge outlet, and wherein the third driver overturns the tray to discharge received medication through the discharge outlet.

12. An apparatus according to claim 6 wherein at least one of the cassettes includes circumferentially spaced apart walls defining compartments adapted to hold medication tablets, the walls being formed of a flexible material that yields in response to external pressure to resist entrapment of medication tablets in the compartments.

13. An apparatus according to claim 1 or 6 wherein the first driver comprises a linear screw along which the single actuator moves.

14. An apparatus for dispensing medication comprising a carousel adapted to hold medication including a drive member to rotate the carousel about a rotational axis to discharge medication, and a single actuator including a first driver to move the single actuator in a first path generally parallel to the rotational axis into and out of alignment with the drive member, a second driver that engages the drive member the single actuator is in alignment with to impart rotation to the carousel and dispense medication from the associated carousel, a tray that moves with the single actuator along the first path to receive medication dispensed from the carousel rotated by the second driver, and a third driver that pivots the tray about an axis to discharge received medication, the axis being generally parallel to the first path.

15. An apparatus according to claim 14 and further including a support for the carousel along which the carousel is movable in a second path generally perpendicular to the first path in a direction away from the single actuator, thereby preventing engagement between the second driver and the drive member, and in a direction toward the single actuator, thereby enabling the engagement.

16. An apparatus according to claim 14 wherein the first driver includes a linear screw.

17. An apparatus according to claim 14 wherein at least one of the carousels includes circumferentially spaced apart walls defining compartments adapted to hold medication tablets, the walls being formed of a flexible material that yields in response to external pressure to resist entrapment of medication tablets in the compartments.

* * * * *